United States Patent [19]

Johnson et al.

[11] Patent Number: 4,919,349

[45] Date of Patent: Apr. 24, 1990

[54] DUST SEAL FOR GYRATORY ROCK CRUSHERS

[76] Inventors: Louis W. Johnson; Bruce G. Johnson, both of 2435 Prairie Rd., Eugene, Oreg. 97402

[21] Appl. No.: 419,031

[22] Filed: Oct. 10, 1989

[51] Int. Cl.[5] ..... B02C 2/04

[52] U.S. Cl. ..... 241/215; 241/216

[58] Field of Search ..... 241/207–216, 241/286, 290

[56] References Cited

U.S. PATENT DOCUMENTS

| | | | |
|---|---|---|---|
| 2,224,542 | 12/1940 | Gruender et al. | 83/10 |
| 2,833,486 | 5/1958 | MacLeod | 241/216 X |
| 4,179,076 | 12/1979 | Barrot et al. | 241/207 X |
| 4,787,563 | 11/1988 | Tanaka et al. | 241/215 X |

*Primary Examiner*—Timothy V. Eley

[57] ABSTRACT

A gyratory rock crusher having a base seal and a cone seal. The cone seal has a recess for receiving a projecting portion of the base seal, and these portions have cooperating upper and lower spherical surfaces arranged for relative parallel movement upon gyratory movement of the cone. The projecting portion has a thickness less than the width of the recess and springs are provided for holding the base seal upwardly against the cone seal to provide sealing engagement between upper surfaces of the two seals and to provide a space between lower surfaces thereof. Forced air is moved into the recess by a plurality of ducts in the projecting portion and discharge of forced air is through the lower space whereby to block the entrance of contaminants into the crusher. A deflector is mounted on the end of the projecting portion to reverse movement of the incoming air and efficiently direct such air through the space for blocking the entrance of contaminants. Engaging surfaces of the cone and base seals are provided with a dust sealing insert and a thrust insert.

17 Claims, 3 Drawing Sheets

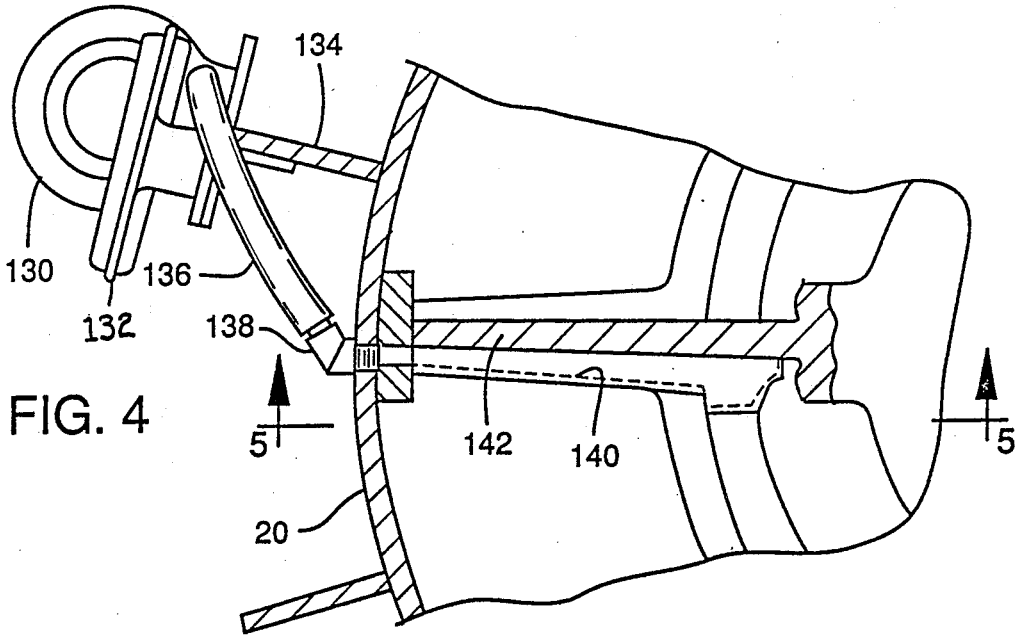
FIG. 4
FIG. 6
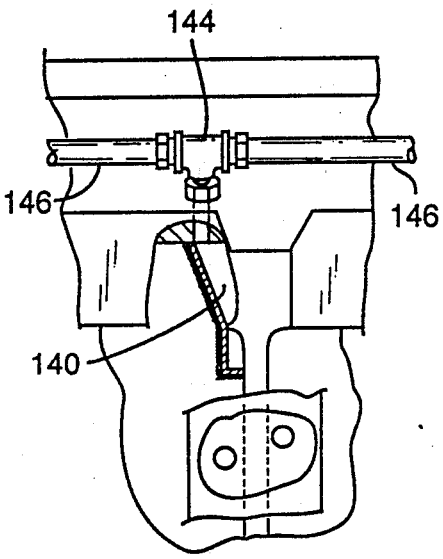
FIG. 5
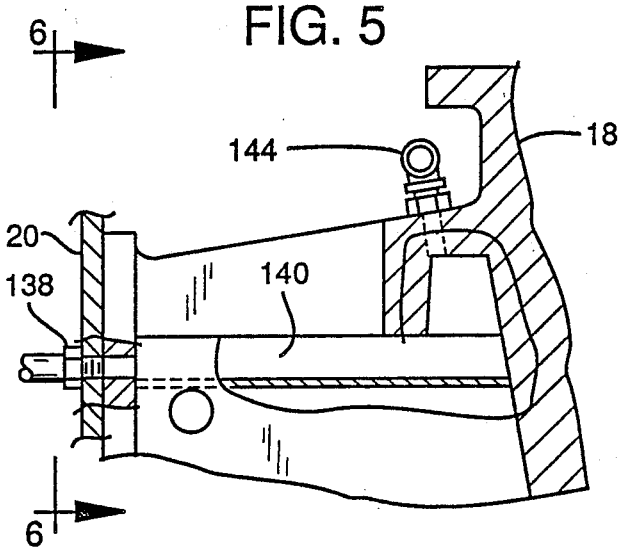

DUST SEAL FOR GYRATORY ROCK CRUSHERS

BACKGROUND OF THE INVENTION

This invention relates to new and useful improvements in dust seals for gyratory rock crushers.

Effective dust seals for cone or gyratory-type rock crushers have been extremely difficult to achieve. The internal working parts (bearings, gears, shafts, oil pumps, and lubricating oil) must be protected from both rock dust developed during crushing and other contaminants, otherwise the best machines become too costly to maintain. No matter how good the crusher may be, if rock dust cannot be excluded, the machine is not viable.

Certain mechanisms using spinning labrynth seals, such as shown in U.S. Pat. No. 3,118,623, are very effective for excluding dust, but such machines are restricted to smaller sizes because of the very high cost, speed limitations, and inadequate load carrying capacities of larger roller thrust bearings. In the larger sizes which are required to produce crushed rock in the capacities that today's and future markets demand, bigger crushers are essential.

Flexible seals have also been used, such as shown in U.S. Pat. Nos. 2,224,542, 2,832,547 and 4,192,472. Such seals comprise frusto-conical members secured between the crusher head and head support and can be designed for the larger type crusher. In view of the violent action of the crusher head, however, such flexible seals have been found to be short-lived. Rubbing seals have also been used and have a structure wherein one part of the seal is stationary on the base frame and the other part is attached to the gyrating cone head. Such a seal exposes a substantial surface area in a continuously moving orbit to the crusher's center line. Very fine rock dust will adhere to this surface. As this surface moves inward, most of the dust will be rubbed off but some will succeed in passing between the sealing surfaces. Over a period of time, dust accumulation reaches destructive levels. Efforts have also been made to use internal air pressure but such have not been satisfactory since it is difficult to push dust out and effective means have not been provided to resist air flowing into internal working parts.

SUMMARY OF THE INVENTION

A primary object of the present invention is to provide a dust seal for gyratory rock crushers which utilizes an improved arrangement of the rubbing type seal wherein such seal is used in combination with air circulating means to efficiently prevent the inlet of dust and other contaminants into internal working parts.

A more particular object of the invention is to provide a dust seal of the type described which provides in combination a novel arrangement of base seal and cone head seal wherein resilient support means provide a sealed engagement between two surfaces of these members and also provide a spaced association with two other surfaces having a contaminant blocking air flow between them.

In carrying out these objectives, a base seal is supported on the base frame and has recessed association with a cone seal. Recessed and projecting portions of these surfaces are arranged for relative parallel movement in the gyratory movement of the cone. The projecting portion has a thickness less than the distance between upper and lower surfaces of the recessed portion, and means resiliently hold the base seal upwardly against the cone seal to provide sealing engagement therewith and also to provide a space between lower surfaces to form a contaminant blocking air seal. Deflecting means are provided in the recessed portion for reversing the movement of incoming air whereby to direct it out efficiently through the space between the base and cone seals. The seal between the base seal and cone seal comprises a low friction plastic insert operating in combination with a low friction thrust bearing insert.

The invention will be better understood and additional objects and advantages will become apparent from the following description taken in connection with the accompanying drawings.

BRIEF DESCRIPTION OF THE DRAWINGS

FIG. 4 is a fragmentary bottom view of air supply means used with the present dust seal.

FIG. 5 is a fragmentary sectional view taken on the line 5—5 of FIG. 4; and FIG. 6 is a fragmentary elevational view taken on the line 6—6 of FIG. 5.

DETAILED DESCRIPTION OF A PREFERRED EMBODIMENT

Figure 1:
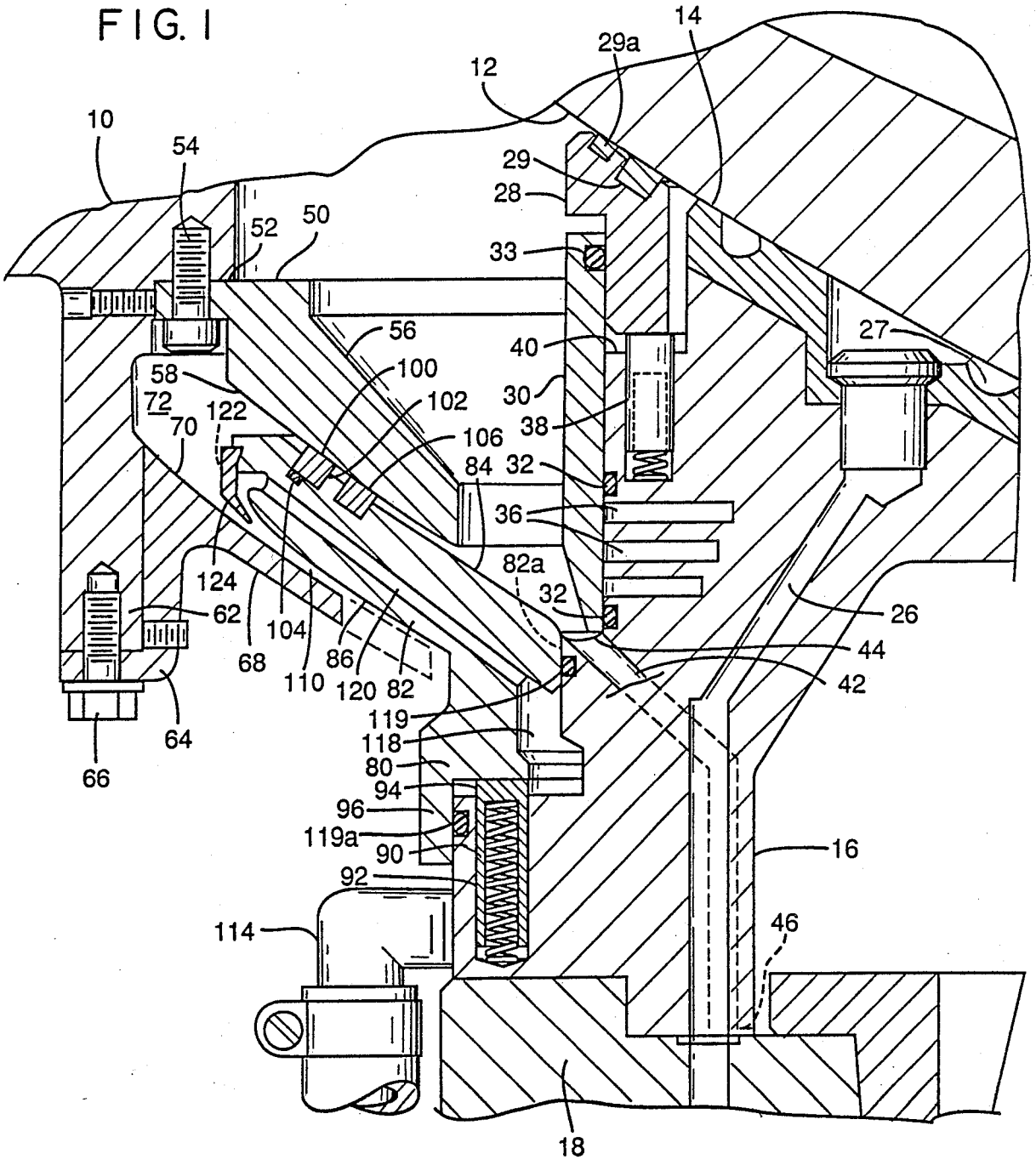
FIG. 1 is a foreshortened vertical sectional view of a gyratory rock crusher and dust seal employing principles of the present invention.

With particular reference to the drawings and first to FIG. 1, the numeral 10 represents a crusher cone or head 10. This cone is associated with a mantle and bowl, not shown, which function together to crash rock. The cone has a lower convex spherical bearing surface 12 slidably supported on an upper spherical surface 14 of a cone support 16 secured to the base frame 18 of the crusher.

Base frame 18 houses operating mechanism for an upright shaft, not shown, connected to the crusher cone and operative to produce the gyrating movement of the cone on the supporting surface 14. Crusher frame 18 is associated with an outer defining wall 20, FIGS. 4 and 5, and other support structure which is well understood in the art and thus not shown.

The spherical support surface 14 comprises a suitable bearing surface, including lubricating means 26 and an annular trough 27 in which hydrostatic lift is applied. The support surface also includes a sealing ring 28 with an oil seal insert 29 and a thrust insert **29*a* adjacent the outer periphery of the surface 14. Thrust insert 29*a* comprises a durable plastic or metal insert and serves to prevent excessive pressure on the seal insert 29. Cone support 16 has a vertical sealing band or ring 30 extending upwardly in partial overlapping surface engagement with the sealing ring 28. This band is associated with lower seals 32 engageable with the ring 28. Band 30 forms an outer defining wall for water cooling ducts 36. Sealing ring 28 is urged upwardly into engagement with the cone head surface 12 by a plurality of spring supported plungers 38 mounted in an outer notched portion 40 of the cone support 16. In the event that lubricant associated with the head should escape past the seals 29, it will flow by gravity down to an annular pick-up trough 44 and then down to an internal part of the machine through one or more drain passageways 42 in the cone support 16 and lateral ports 46**.

Dust seal means associated with the present crusher structure which prevent dust and other contaminants from entering through the area between the cone and inner crusher parts comprises an upper cone seal ring 50 secured to a downwardly facing shoulder 52 of the cone as by a plurality of cap screws 54. Seal ring 50 has an inwardly and downwardly angled portion 56 with a lower smooth surface 58. Cone 10 has an outer depending peripheral flange 62 supporting a lower cone seal ring 64 on its bottom edge, as by cap screws 66. Lower cone seal ring 64 has a downwardly angled portion 68 with an upper smooth surface 70. The two surfaces 58 and 70 are concentric and form a recess 72 therebetween.

The dust seal of the invention also employs an upstanding base seal 80 having an upwardly and outwardly angled portion 82 projecting into the recess 72. The surfaces 84 and 86 of the base seal portion 82 and the surfaces 58 and 70 of the cone seal, respectively, have a matching spherical shape for movable concentric association upon orbiting gyration of the head.

Figure 2:
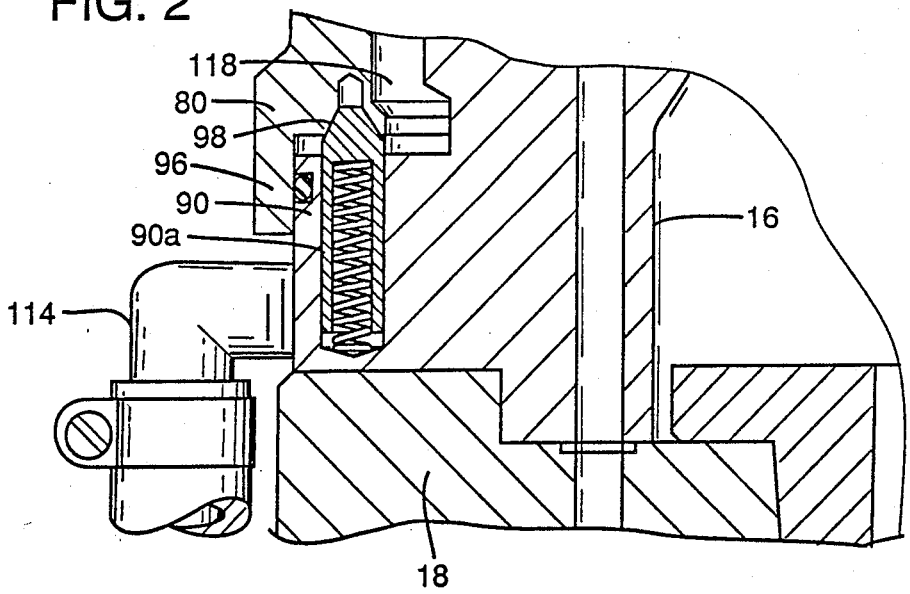
FIG. 2 is an enlarged fragmentary sectional view taken similar to FIG. 1 but offset circumferentially therefrom, this view showing means that lock the base seal against rotation.

The thickness of base seal portion 82 is less than the width of the recess 72 and is held against the upper surface 58 of the recess by a plurality of spring pressed plungers 90 confined slidably in recesses 92 in the cone support 16 and having a flat upper end 94 engaged with the bottom of base seal 80. Base seal 80 has a flange 96 which depends in a clearance fit with an outer vertical surface of the cone support 16 to provide a cylindrical surface for the base seal. The inner end **82*a* of the extension 82 has a clearance slidable fit with the cone support 16. The number of spring pressed plungers 90 may vary but it is preferred that they be considerable, for example, twenty, whereby a uniform upward force will be applied around the cone. With reference to FIG. 2, a few, such as three, of the plungers 90*a* have a tapered or cone-shaped end which extends into similarly shaped recesses 98 in the base seal. These plungers assist plungers 90** in the upward lift of the base seal and also lock the base seal against rotation.

The upper surface 84 of base seal 82 carries a low friction plastic air and dust seal insert 100, such as Teflon, seated in a notch 102 and projecting from the notch for engagement with surface 58 of the upper cone seal ring 50. The outer face of insert 100 aligns to the arc center of all the spherical parts. The upper corner of seal 100 is urged resiliently against spherical surface 58 by an O-ring 104 thereunder. Adjacent to the insert 100 and disposed toward the inner portion of the crusher is a second low friction insert 106, such as Teflon or Delrin, also seated in a notch 102. Insert 106 comprises a thrust member to bear the force of the spring pressed plungers 90. The insert 100 can also accept some thrust load and reduce the pressure on insert 106.

The parts are dimensioned and arranged such that with the base seal 82 held upwardly and its inserts 100 and 106 in engagement with the surface 58, a small space 110 exists between the base seal 82 and the surface 70 of the recess. This space comprises a full circumferential outlet for forced air which is admitted to the outer end of base seal extension 82, as will now be described.

Figure 3:
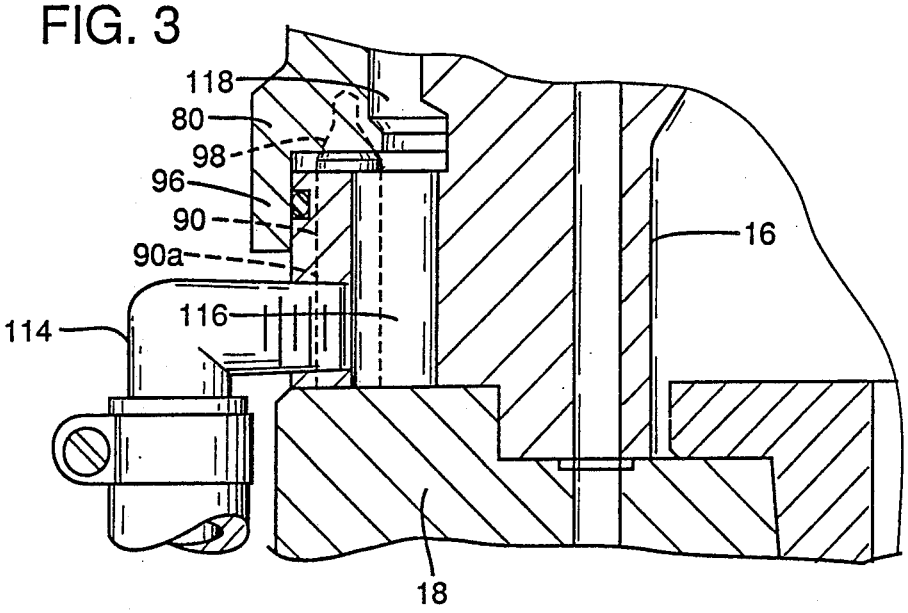
FIG. 3 is an enlarged fragmentary sectional view also taken similar to FIG. 1 but offset circumferentially therefrom, this view showing air intake means.

The numeral 114 designates an inlet fitting from a source of forced air. Preferably a pair of such fittings are provided and spaced 180 degrees apart for efficient balanced inlet of air to the cone support 16. Each of the fittings 114 communicates with a vertical port 116, FIG. 3, in the cone support 16. Ports 116 are located intermediate plungers 90 or **90*a* and communicate with an annular passageway 118 which is formed between the support 16 and the base seal 80. An air seal 119 is provided between the inner end of extension 82 and the cone support to prevent air from escaping upwardly and an air seal 119*a* is provided between the depending flange 96 and cone support 16 to prevent air from escaping downwardly. Passageway 118 communicates with a plurality of air ducts or passageways 120, for example 36 in number, leading from the inner end of base seal extension 82 to its outer end. Forced air thus admitted to the annular passageway 118 will be forced out the upper end of extension 82 and discharged through the space 110 to provide an air block and prevent contaminants from entering between the cone and the internal workings of the crusher. In a preferred structure, the outer end of the base seal extension 82 supports an upright deflection 122 having a bottom portion 124 angled toward the inner end of the seal portion 82. Thus, air discharged through the outer end of the air passageways 120 will be reversed and reflected back for more efficient movement to prevent the inlet of contaminants. In a preferred construction, deflector 122 has a shrink fit on the end of the base seal portion 82**.

With reference to FIGS. 4, 5 and 6, forced air to fittings 114 and inlet ports 116 is supplied from a blower 130 and filter 132, suitable mounted on the crusher, such as on the outside wall 20. If desired, however, these members may comprise a part of independent filtering and blowing mechanisms mounted apart from the crusher. In the arrangement shown, the filter and blower assembly is supported on a bracket 134 secured to the wall 20. The inlet of air to the blower is through the filter and an outlet conduit 136 from the blower leads to a fitting 138 on the wall. This fitting communicates with an inwardly extending paasageway 140 on an upstanding web 142 integral with the crusher. The inner end of passageway 140 extends upwardly in the web to a tee fitting 144 from which conduits 146 lead to the diametrically opposite inlet fittings 114 on the cone support.

In the operation of the crusher, the corresponding spherical surfaces of the base seal 82 and the recess 72 operate concentrically through the full circumference of the gyrating movement of the head. The projecting length of the base seal 82 in the recess is sufficient to always maintain a confined portion thereof within the recess through the stroke whereby there is always a telescoping relationship and an elongated space 110 between the lower surfaces 70 and 82. FIG. 1 shows the cone 10 at mid-stroke. The broken lines illustrate the closest approach of the inner end of portion 68 to the base seal. The large number of the ducts 120 provide even distribution of moving air through the space 110.

In the event that any contaminant should enter the recess 72, seal 100 will prevent it from reaching internal crusher parts. This seal is resiliently maintained in engagement with the surface 58 by its own resiliency and also by the O-ring 104 for long sealing life. The upward force of the base seal 82 against the upper cone seal ring 50 is borne by the inserts 100 and 106.

Deflector 122 efficiently directs incoming air from the ducts in a reverse movement so that the air moves efficiently into the space 110 and out to the exterior of the crusher. In the arrangement shown, dust or other contaminants are blocked against entering the only source of entrance into the internal working parts of the crusher, namely, between the cone and the cone support, and thus such contributes to long efficient life of the crusher.

It is to be understood that the form of our invention herein shown and described is to be taken as a preferred example of the same and that various changes in the shape, size and arrangement of parts may be resorted to without departing from the spirit of our invention, or the scope of the subjoined claims.

Having thus described our invention, we claim:

1. A gyratory rock crusher comprising a base frame,
a base frame,
a crusher cone,
inner drive and support means on said frame moving said cone in a gyratory movement,
cooperating spherical surfaces on said base frame and cone supporting said cone in said gyratory movement,
a base seal on said base frame,
a cone seal on said crusher cone,
one of said base seal and cone seal having a recessed portion and the other of said base seal and cone seal having a portion thereof projecting into said recessed portion,
said recessed and projecting portions having cooperating upper and lower spherical surfaces arranged for relative concentric movement upon gyratory movement of said cone,
said projecting portion having a thickness less than the distance between the upper and lower surfaces of said recessed portion,
forced air means forcing air into said recessed portion,
seal means between the upper surfaces of said recessed and projecting portions,
and means resiliently holding said base seal upwardly against said cone seal to provide sealing engagement between said upper surfaces of said two seal means and to provide a space between said lower surfaces whereby to form a dust seal of moving air between said base and cone seals.

2. The gyratory rock crusher of claim 1 wherein said forced air means extends through said base seal and exits in said recessed portion, and deflecting means directing the moving air through said dust seal space.

3. The gyratory rock crusher of claim 1 wherein said seal means comprises a low friction insert.

4. The gyratory rock crusher of claim 1 wherein said resilient means comprise a plurality of compression springs engageable between said base seal and said base frame.

5. The gyratory rock crusher of claim 1 wherein said resilient means comprise a plurality of spring loaded plungers engageable between said base seal and said base frame, at least some of said plungers having a socket fit in both said base and cone seal to prevent relative rotation of said two seals.

6. A gyratory rock crusher comprising:
a base frame,
a crusher cone,
inner drive and support means on said frame moving said cone in a gyratory movement,
cooperating spherical surfaces on said base frame and cone supporting said cone in said gyratory movement,
a base seal on said base frame having an outer free end,
a cone seal on said crusher cone having a recess with a width defined by opposite upper and lower surfaces and movably receiving said base seal with said outer free end of said base seal therein,
said base seal also having upper and lower surfaces and having a thickness less than the width of said recess,
the upper and lower surfaces of said base seal and the upper and lower surfaces of said cone seal recess comprising cooperating spherical surfaces for relative concentric movement upon gyratory movement of said cone,
forced air means admitted to said recess adjacent the outer free end of said base seal,
seal means between the upper surface of said laterally extending portion and the upper portion of said recess,
and means resiliently holding said base seal upwardly to provide sealing engagement of said seal means between the upper surfaces of said base and cone seals and to provide a space between the lower surface of said base seal and the lower surface of said recess whereby to form a dust seal of moving air between said base and cone seals.

7. The gyratory rock crusher of claim 6 wherein said forced air means extends through said base seal and exits at said outer free end thereof, and deflecting means adjacent said free end that directs the exiting air down into said dust seal space.

8. The gyratory rock crusher of claim 6 wherein said forced air means extends through said base seal and exits at said outer free end thereof, and a baffle on said free end of a shape that reverses the exiting air and directs it into said dust seal space.

9. The gyratory rock crusher of claim 8 wherein said baffle comprises a ring member having a recessed mounted engagement on said free end.

10. The gyratory rock crusher of claim 6 wherein said seal means comprises a low friction insert.

11. The gyratory rock crusher of claim 6 wherein said seal means comprises a low friction insert and is used in combination with a low friction insert adjacent thereto providing a spaced relation between said base and cone seals.

12. The gyratory rock crusher of claim 6 wherein said resilient means comprise a plurality of compression springs engageable between said base seal and said base frame.

13. The gyratory rock crusher of claim 6 wherein said resilient means comprise a plurality of spring loaded plungers engageable between said base seal and said base frame, at least some of said plungers having a socket fit in both said base and cone seals to prevent relative rotation of said two seals.

14. The gyratory rock crusher of claim 6 wherein said base seal includes a vertical body portion and a laterally extending portion projecting into said recess, said forced air means including a passageway through said laterally extending portion and exiting into said recess.

15. The gyratory rock crusher of claim 6 wherein said forced air means includes a blower, and air passageway means communicating with said blower and directing air through said base seal to said recess.

16. The gyratory rock crusher of claim 15 herein said air passageway means comprises an annular passageway adjacent said base seal, and a plurality of ducts leading through said base seal from said passageway.

17. The gyratory rock crusher of claim 6 wherein said forced air means includes a blower having an inlet and outlet, a filter at said blower inlet for filtering incoming air, and air passageway means communicating with said blower outlet and directing air through said base seal to said recess.

* * * * *